US005394633A

United States Patent [19]

Alessandri, Jr.

[11] Patent Number: 5,394,633

[45] Date of Patent: Mar. 7, 1995

[54] SHOTGUN SIGHT EXTENSION APPARATUS

[75] Inventor: Louis A. Alessandri, Jr., Rehoboth, Mass.

[73] Assignee: Lou Alessandri & Son, Inc., Rehoboth, Mass.

[21] Appl. No.: 148,289

[22] Filed: Nov. 8, 1993

[51] Int. Cl.[6] ..... F41A 21/40

[52] U.S. Cl. ..... 42/79; 42/100

[58] Field of Search ..... 42/77, 79, 100, 102, 42/106

[56] References Cited

U.S. PATENT DOCUMENTS

| | | | |
|---|---|---|---|
| 797,345 | 8/1905 | Cokeroft | 42/79 |
| 906,443 | 12/1908 | Michaud | 42/79 |
| 927,573 | 7/1909 | Michaud | 42/79 |
| 1,013,974 | 1/1912 | Vandenbossche | 42/79 |
| 1,266,087 | 5/1918 | Williams | 42/79 |
| 1,297,891 | 3/1919 | Moor | 42/77 |
| 2,489,568 | 11/1949 | Ferhot | 42/79 |
| 2,620,583 | 12/1952 | Simmons | 42/102 |
| 2,874,504 | 2/1959 | Martinek | 42/100 |
| 2,984,926 | 5/1961 | Haulin | 42/79 |
| 3,163,953 | 1/1965 | Bridge | 42/79 |

*Primary Examiner*—David Brown
*Attorney, Agent, or Firm*—John A. Haug

[57] ABSTRACT

A cylindrical alongated extender element (20,60,72,80) of various incremental lengths has a bore (22) and a first end portion formed with a sleeve portion (24) and threaded portion (26) adapted to be received in the choke receiving seat (14) formed in the bore of a shotgun barrel. A sight (46) is mounted on a rib (40, 68, 76) which is coextensive in length with the extender elements to provide an improved sight picture. The extender elements are adapted for use with a single barrel gun or a double barrel over-and-under and side-by-side arrangements. With the over-and-under arrangement a rib assembly having a single tubular portion mounting the rib is mounted on an adaptor seat of one of the extender elements and with the side-by-side arrangement a rib assembly has first and second tubular portions mounting the rib and received on adaptor seats of two extender elements. The extender elements can optionally, in turn, be provided with choke receiving seats.

12 Claims, 2 Drawing Sheets

SHOTGUN SIGHT EXTENSION APPARATUS

BACKGROUND OF INVENTION

This invention relates generally to guns and more particularly to shotguns.

Shotguns are conventionally provided with barrels of various lengths to allow for optimum use for a particular type of shooting. A longer barrel improves the sight plain and therefore provides greated accuracy and is more useful for certain kinds of game hunting, for example, than a similar gun with a shorter barrel. For other types of hunting, for example for use in hunting upland game, guns having a shorter barrel perform well and are frequently preferred for general use. Further, the use of chokes, which control the shot pattern, can be employed to modify a given gun making it adaptable for different purposes.

In recent years sporting clay shooting, in all its variations, has become very popular with many competitions being held throughout the country. A person having a shotgun with a long barrel at certain stations of a course has an advantage in such competitions over one having a shorter barrel. That is, with a longer barrel the front sight adjacent the discharge end of the barrel is further removed from the rear sight. This provides an improved sight picture compared to shorter barrels and therefore results in more accurate shooting. At other stations a fast response is more important so that a shorter barrel is preferred. In addition to sporting clay shooting, trap and skeet shooting maintain their popularity. While longer barrels are preferred for trap shooting, shorter barrels are preferred for skeet shooting. The result is that people are faced with the dilemma that if they want to optimize their performance for different types of shooting they are required to buy several guns having barrels of different lengths, however, this becomes very expensive and, from a practical viewpoint, an unavailable option for many people.

It is as object of the present invention to provide apparatus which overcomes the above noted prior art limitations.

SUMMARY OF THE INVENTION

Briefly, in accordance with the present invention, a generally cylindrical elongated extender element having a bore matching that of a selected shotgun bore and having first and second end portions is formed with the first end portion configured to be received in a choke receiving seat provided in the barrel of the shotgun. A front sight is mounted on the second end portion adjacent its end to provide an elongated distance between the rear and front sights. In one embodiment the front sight is mounted on a rib integrally attached to the extender element and extending longitudinally along the first end portion to be coextensive in length therewith. In another embodiment, particularly useful with shotguns having short, either single or over-and-under barrels, a rib assembly comprises a tubular portion and a rib, the rib attached to the tubular portion at its outer periphery and extending longitudinally along and projecting beyond the tubular portion to a free distal end. The tubular portion is received on an adapter seat formed on an extender element, the seat having a reduced periphery forming a retention flange and being disposed intermediate the first and second end portions. The extender element is receivable in the upper barrel with the rib and the second end portion of the extender element being essentially coextensive in length. According to a feature of the invention the rib assembly is locked on the extender element at a selected angular position. For a gun having over-and-under barrels a second cylindical adaptor element, not having a rib or sight is receivable in the lower barrel and is esentially coextensive in length with the extender element in the upper barrel.

In another embodiment of the invention the elongated extender elements are each formed with an adaptor seat to receive a rib assembly having first and second tubular portions with an attached rib disposed therebetween, the first and second tubular portions receivable on respective adaptor seats with the first end portions receivable in choke receiving seats of side-by-side barrels of a shotgun. According to a feature of the invention the extender elements may be provided in several different lengths in order to modify the effective length of a shotgun barrel to any of several lengths. According to other features of the invention the extender elements may be formed with choke receiving seats in their bores and may be provided with slots formed in the outer distal ends of the second end portions to facilitate installation and removal of the extender elements.

Various other objects and advantages will appear from the following description of an embodiment of the invention and the novel features will be particularly pointed out hereinafter in connection with the accompanying drawings and the appended claims.

DETAILED DESCRIPTION OF PREFERRED EMBODIMENTS

Figure 1:
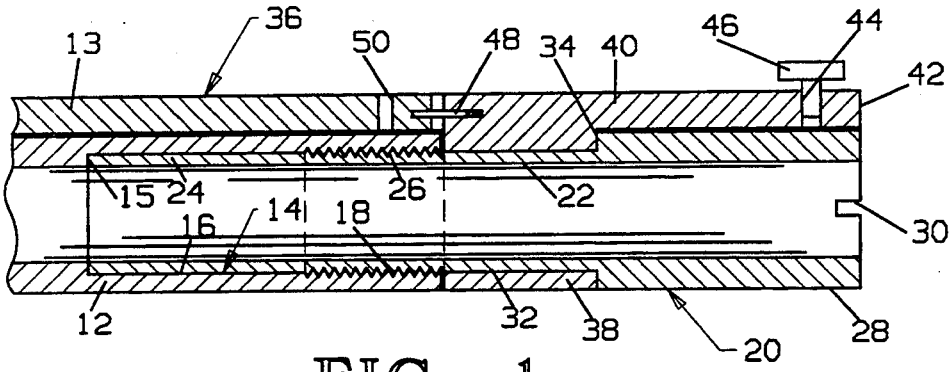
FIG. 1 is a cross sectional view of the discharge end of a shotgun barrel showing an extender element and rib assembly made in accordance with the invention mounted in the choke receiving seat of the barrel.

With reference to FIG. 1 the discharge end of a shotgun barrel 12 is shown with a choke receiving seat 14 formed in the bore of the barrel. Seat 14 comprises an enlarged diameter portion 16 and a threaded portion 18 outboard of portion 16 and extending to the end of barrel 12. A generally cylindrical elongated extender element 20 having a bore 22 preferably matching that of barrel 12 is formed having a first end portion with a sleeve portion 24 having an outside diameter chosen to fit closely in enlarged diameter portion 16 of barrel 12 and a threaded portion 26 matching that of threaded portion 18. Extender element 20 has a second end portion having an outside diameter 28 preferably matching that of barrel 12 and preferably formed with at least one pair of longitudinally extending aligned slots 30 (one slot being shown in the figure) in the outer distal end of the extender element to facilitate insertion of the extender element into barrel 12 and removal of the element when desired. An adaptor seat 32 is disposed on extender element intermediate the first and second end portions and is preferably formed having a reduced diameter effectively forming a retention flange 34 for a purpose to be described below.

Figure 2:
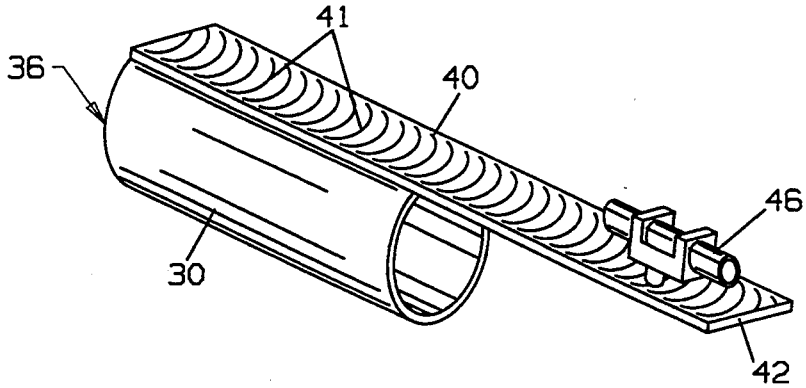
FIG. 2 is a perspective view of a rib assembly used in the FIG. 1 embodiment.

A rib assembly 36 (see also FIG. 2) has a tubular portion 38 and a rib 40 extending longitudinally along the outer periphery of tubular portion 38 and projecting beyond the tubular portion to a distal free end 42. Rib 40 has a height and width selected to generally match that of a conventional rib 13 of a shotgun. If desired, the top surface of rib 40 can be formed with an indented swirl pattern 41 or the like to match patterns used on ribs of conventional shotguns.

Sight mounting means is provided on rib 40 in the form of a bore 44 located adjacent the free distal end 42 of rib 40 for reception of a conventional sight 46.

Rib assembly 36 is received on adaptor seat 32 and then the first end portion of the extender element is screwed into the choke receiving seat 14 until it bottoms out in the bore of barrel 12 against shoulder 15 forming a continuous smooth surface of the bore leaving essentially no space between the extender element and shoulder 15. The longitudinal length of tubular portion 38 is chosen to be no more than and preferably slightly less than the distance between flange 34 and the end of the barrel when the adaptor element is seated in the choke seat to ensure that there is no space between the extender element and shoulder 15.

The angular orientation of the rib assembly is locked by suitable means to maintain rib 40 aligned with rib 13 and concomitantly to maintain sight 46 in its proper angular position. This can be conveniently accomplished by means of a spring biased pin 48 extending longitudinally from rib 40 and adapted to be received in a longitudinally extending bore formed in the outer distal end of rib 13 of the shotgun. Other locking means could be employed, if desired, such as forming mating flat longitudinally extending sufaces on the adaptor seat and inner surface of the tubular portion.

It will be appreciated that when extender element 20 and rib assembly 36 are attached to the shotgun the normal snap in sight receivable in bore 50 in rib 13 of the shotgun is removed so that an extended distance is provided between the rear sight of the shotgun (not shown) and the front sight thereby improving the sight picture.

Figure 3:
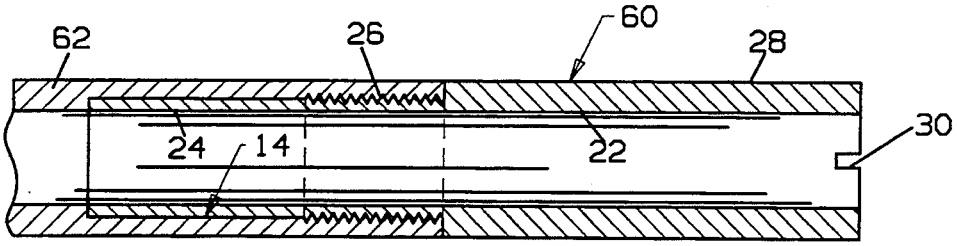
FIG. 3 is a cross sectional view similar to FIG. 1 of an extender element adapted for use in the lower barrel of an over-and-under shotgun.

FIG. 3 shows an extender element 60 adapted for use with the bottom barrel of a two barrel over-and-under shotgun in which the two barrels are vertically aligned. Extender element 60 is formed with the same first and second end portions having a bore 22 matching that of the bore of the bottom barrel and having a sleeve 24 and threaded portion 26 received in choke receiving seat 14. Extender element 60 also has a second end portion having an outer diameter 28 essentially the same as that of barrel 62 and the same longitudinally extending wrench receiving slots 30 formed in the distal outer end of the extender element. Extender element 60 however, has no adaptor seat and the longitudinal length of sleeve 24 and threaded portion 26 is chosen to be at least equal to and preferably slightly greater than the longitudinal length of seat receiving portion 14 to ensure that the extender element can bottom out against shoulder 15. The longitudinal length of rib 40 and the extender elements are selected so that they are essentially coextensive.

Figure 4:
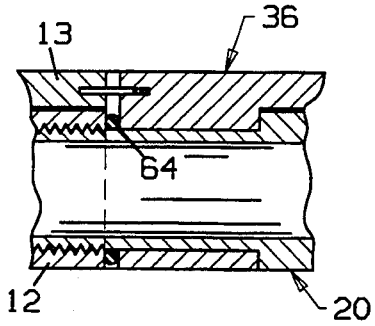
FIG. 4 is a broken away cross sectional view of a modification of the FIG. 1 embodiment.

As shown in FIG. 4, an O-ring 64 can be placed between rib assembly 36 and barrel 12, if desired, so that the longitudinal length of the tubular portion can be shortened slightly to ensure that the extender element bottoms out in its seat while at the same time takes up any looseness in the rib assembly.

Figure 5:
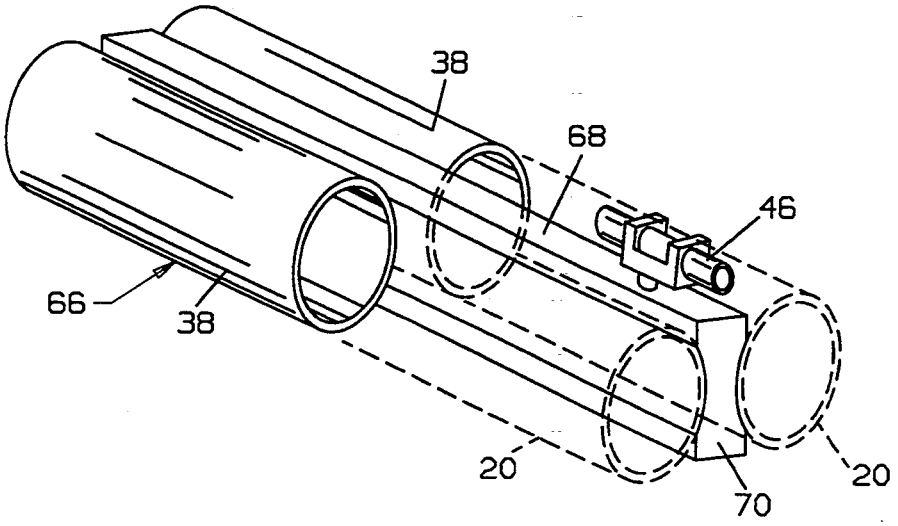
FIG. 5 is a perspective view of a modified rib assembly particularly adapted for use with a side-by-side shotgun.

FIG. 5 shows a rib assembly 66 particularly adapted for use with a double barrel shotgun having side-by-side barrels in horizontal alignment with each other. Rib assembly 66 comprises first and second tubular portions 38 as described with relation to the FIG. 2 rib assembly with a rib 68 centrally disposed between and attached to the tubular portions. As in the FIG. 2 assembly a sight is mounted adjacent the free distal end 70 of rib 68. In using the FIG. 5 rib assembly first and second extender elements 20, as shown in FIG. 1, would be inserted through respective tubular portions 38 of rib assembly 66 and inserted into the choke receiving seats of respective side-by-side barrels with the extender elements and the rib being essentially coextensive in length.

Figure 6:
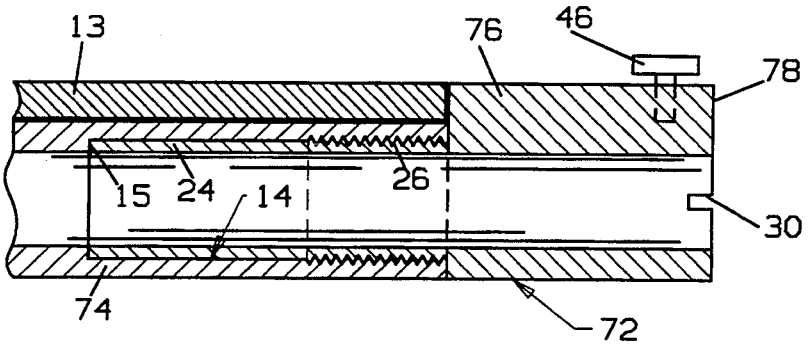
FIG. 6 is a cross sectional view of a modified elongated extender element.

FIG. 6 shows a modified extender element 72 which could be used with a shotgun having a single barrel 74. Extender element 72 is similar to the FIG. 3 extender element 60 however it is provided with a rib 76 which is used to mount sight 46 adjacent free distal end 78 in the same manner as that of extender elements 20 and 60 of FIGS. 1 and 3.

Figure 7:
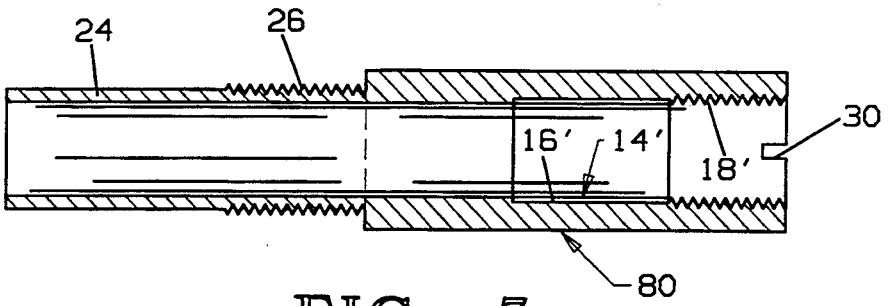
FIG. 7 is a cross sectional view of another modified elongated extender element.

The extender elements may also, in turn, be provided with choke receiving seats as shown in FIG. 7 in order to provide the ability to not only change the effective length of the shotgun barrel and sight picture but also to be able to control the shot pattern in the usual manner by mounting any selected choke, e.g. full, modified, skeet, etc., in the choke receiving seat of the extender element. As seen in FIG. 7, extender element 80 is formed with a choke receiving seat 14' comprising an enlarged diameter portion 16' and a threaded portion 18' outboard of the enlarged diameter portion.

It will be understood that for a given gauge gun, i.e., 12, 16, 20 etc., extender elements of several different intermediate lengths can be provided, such as in 2, 4, 6, and 8 inch lengths so that a given gun can easily be optimized for a variety of different shooting requirements. Thus by means of the invention a shooter can, with a minimum of expense, adapt his gun, whether single or double barrel shotgun, for a particular type of shooting. The invention also provides the advantage that a shooter can venture out on an expedition or the like having the capacity for adapting his gun to any given requirement with only a modest need for storage for a full set of extender elements and chokes.

It will be understood that various changes in the details, materials and arrangement of parts, which have been described and illustrated in order to explain the nature of the invention, may be made by those skilled in the art within the principle and scope of the invention, as expressed in the appended claims.

What is claimed:

1. Apparatus for use with a shotgun having first and second barrels each having a choke receiving seat formed in the bore of the respective barrel comprising a first cylindrical elongated extender element having a bore and having opposite first and second end portions, the first end portion receivable in the choke receiving seat of the first barrel, the second end portion having a selected outside diameter, a tubular adaptor seats disposed on the extender element intermediate the first and second end portions, the adaptor seat having a reduced outside periphery relative to the selected diameter farming a radially extending retention flange and a rib assembly comprising a tubular portion and a rib, the rib mounted on the tubular portion and extending longitudinally along the portion on the outer periphery thereof and projecting beyond the tubular portion to a free distal end, means to mount a sight on the rib adjacent the free distal end, the tubular portion received on the adaptor seat with the projecting rib being essentially coextensive in length with the second end portion of the extender element when the tubular portion is disposed in engagement with the retention flange of the first elongated extender element with the first end portion of the first extender element received in the choke seat of the first barrel, a second cylindrical elongated extender element having a bore and having opposite first and second end portions, the first end portion receivable in the choke receiving seat of the second barrel, the first and second elongated extender elements being coextensive in length.

2. Apparatus according to claim 1 in which a choke receiving seat is formed in the bore of each respective extender element.

3. Apparatus according to claim 1 in which the second end portion of the first and second elongated extender elements each has a free distal end and a plurality of slots are formed in each distal free end of the second end portions.

4. Apparatus according to claim 1 further including means to lock the rib assembly on the adaptor seat at a selected angular position.

5. Apparatus according to claim 4 in which the means to lock the rib assembly includes a spring biased pin extending longitudinally from the first end portion of the first elongated extender element.

6. Apparatus for use with a shotgun having rear and front sights and having a barrel with a choke receiving seat formed in the bore of the barrel comprising a cylindrical elongated extender element having a bore and having first and second and portions, the first end received in the choke receiving set and means to mount a sight adjacent the second end portion whereby the length between rear and front sights on the shotgun is extended, the means to mount a sight including a rib formed on the extender element, the rib extending longitudinally on the outer periphery of the extender element.

7. Apparatus for use with a shotgun having rear and front sights and having a barrel with a choke receiving seat formed in the bore of the barrel comprising a cylindrical elongated extender element having a bore and having first and second end portions, the first end received in the choke receiving seat and means to mount a sight adjacent the second end portion whereby the length between rear and front sights on the shotgun is extended, the means to mount a sight including a rib assembly comprising a tubular portion and a rib, the rib mounted on the tubular portion and extending longitudinally along the tubular portion on the outer periphery thereof and projecting beyond the tubular portion to a free distal end and means to mount a sight on the rib adjacent the free distal end, the tubular portion being received on a seat formed on the extender element intermediate the first and second end portions with the projecting rib being essentially coextensive in length with the second end portion of the extender element.

8. Apparatus for use with a shotgun having rear and front sights and having a barrel with a choke receiving seat formed in the bore of the barrel comprising a cylindrical elongated extender element having a bore and having first and second end portions, the first end received in the choke receiving seat and means to mount a sight adjacent the second end portion whereby the length between rear and front sights On the shotgun is extended, and a choke receiving seat being formed in the bore of the extender element.

9. Apparatus for use with a shotgun having rear and front sights and having a barrel with a choke receiving seat formed in the bore of the barrel comprising a cylindrical elongated extender element having a bore and having first and second end portions, the first end received in the choke receiving seat and means to mount a sight adjacent the second end portion whereby the length between rear and front sights on the shotgun is extended, the apparatus being adapted for use with a shotgun having a second barrel, the barrels being arranged horizontally, side-by-side, in alignment with each other, the bore of each barrel having a choke receiving seat, a second cylindrical extender element having a bore and having first and second end portions, the first end portion of the second extender element receivable in the choke receiving seat of the second barrel, the means to mount a sight including a rib assembly comprising first and second tubular portions and a rib, the rib mounted on and intermediate the tubular portions and extending longitudinally along the tubular portions and projecting beyond the tubular portions to a free distal end, the first and second tubular portions received on a respective seat formed on the first and second elongated extender elements intermediate the first and second end portions, and means to mount a sight on the rib adjacent the free distal end thereof, the projecting rib being essentially coextensive in length with the second end portions of the extender elements.

10. Apparatus according to claim 9 in which a choke receiving seat is formed in the bore of each extender element.

11. Apparatus for use with a shotgun having a barrel having a choke receiving seat formed in the bore of the barrel comprising a cylindrical elongated extender element having a bore and having opposite first and second end portions, the first end portion receivable in the choke receiving seat of the barrel, the second end portion having a selected outside diameter, a tubular adaptor seat disposed on the extender element intermediate the first and second end portions, the adaptor seat having a reduced outside periphery relative to the selected diameter forming a radially extending retention flange and a rib assembly comprising a tubular portion and a rib, the rib mounted on the tubular portion and extending longitudinally along the portion on the outer periphery thereof and projecting beyond the tubular portion to a free distal end, means to mount a sight on the rib adjacent the free distal end, the tubular portion received on the adaptor seat with the projecting rib being essentially coextensive in length with the second end portion of the extender element when the tubular portion is disposed in engagement with the retention flange of the elongated extender element with the first end portion of the extender element received in the choke seat of the barrel.

12. Apparatus according to claim 11 in which a choke receiving seat is formed in the bore of the extender element.

* * * * *